United States Patent [19]

Yamanoi et al.

[11] Patent Number: 4,463,223

[45] Date of Patent: Jul. 31, 1984

[54] HEAD PHONE

[75] Inventors: Masaru Yamanoi; Hiroshi Satoh, both of Kawasaki, Japan

[73] Assignee: Nippon Columbia Kabushikikaisha, Tokyo, Japan

[21] Appl. No.: 389,374

[22] Filed: Jun. 17, 1982

[30] Foreign Application Priority Data

Jul. 10, 1981 [JP] Japan ..... 56-102535[U]

[51] Int. Cl.[3] ..... H04R 1/10

[52] U.S. Cl. ..... 179/156 R; 179/182 R; 2/209

[58] Field of Search ..... 179/156 R, 156 A, 182 R; 2/209; D14/36

[56] References Cited

U.S. PATENT DOCUMENTS

D. 265,557 7/1982 Besasie ..... D14/36
D. 266,244 9/1982 Hofer ..... D14/36

FOREIGN PATENT DOCUMENTS 71464 9/1983 European Pat. Off. ..... 179/156 R
741692 6/1939 Fed. Rep. of Germany ... 179/156 R
2642786 12/1976 Fed. Rep. of Germany ... 179/156 R
1218086 11/1969 United Kingdom ..... 179/156 R

OTHER PUBLICATIONS

"New Breakthrough . . . ," *HiFi Stereo,* L. Feldman, Jun. 1981, p. 51.

"Stereophones," *Stereo Discounters Catalog,* Aug. 1982.

*Primary Examiner*—G. Z. Rubinson
*Assistant Examiner*—L. C. Schroeder
*Attorney, Agent, or Firm*—Murray Schaffer

[57] ABSTRACT

A head phone is disclosed, which includes a pair of housings, each holding therein an electro-acoustic transducer, a head band being extendable and shrinkable, a pair of supporting members, each being curved in substantially inverse L-shape with each other and supporting at its one end one of the pair of housings, and a pair of pivotally supporting members, each being fixed with one of both ends of the head band and pivotally supporting the other end of one of the pair of supporting members in such a manner that each of the supporting members is rotatable around its lengthwise direction and also rotatable against the extending direction of the head band.

7 Claims, 4 Drawing Figures

FIG. 3
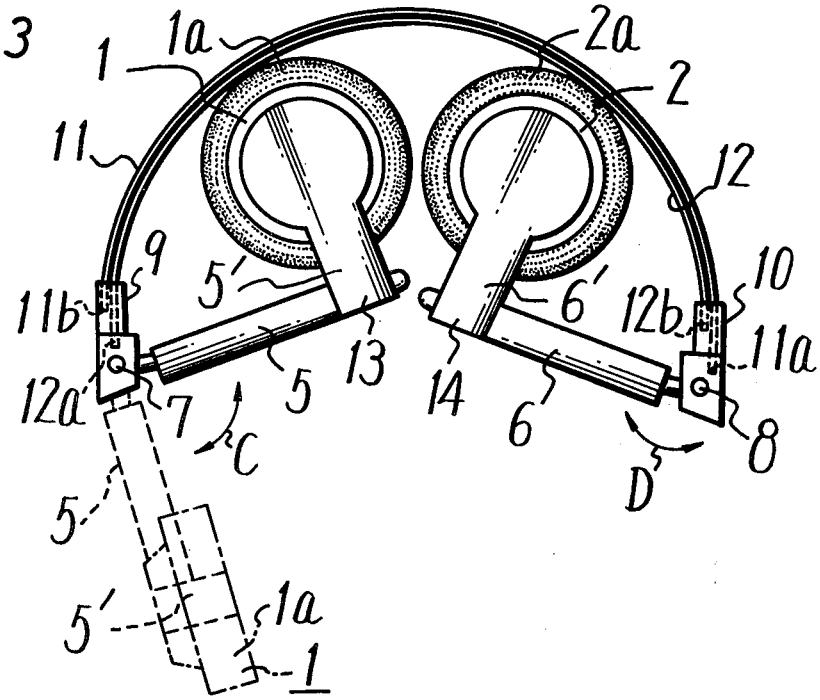
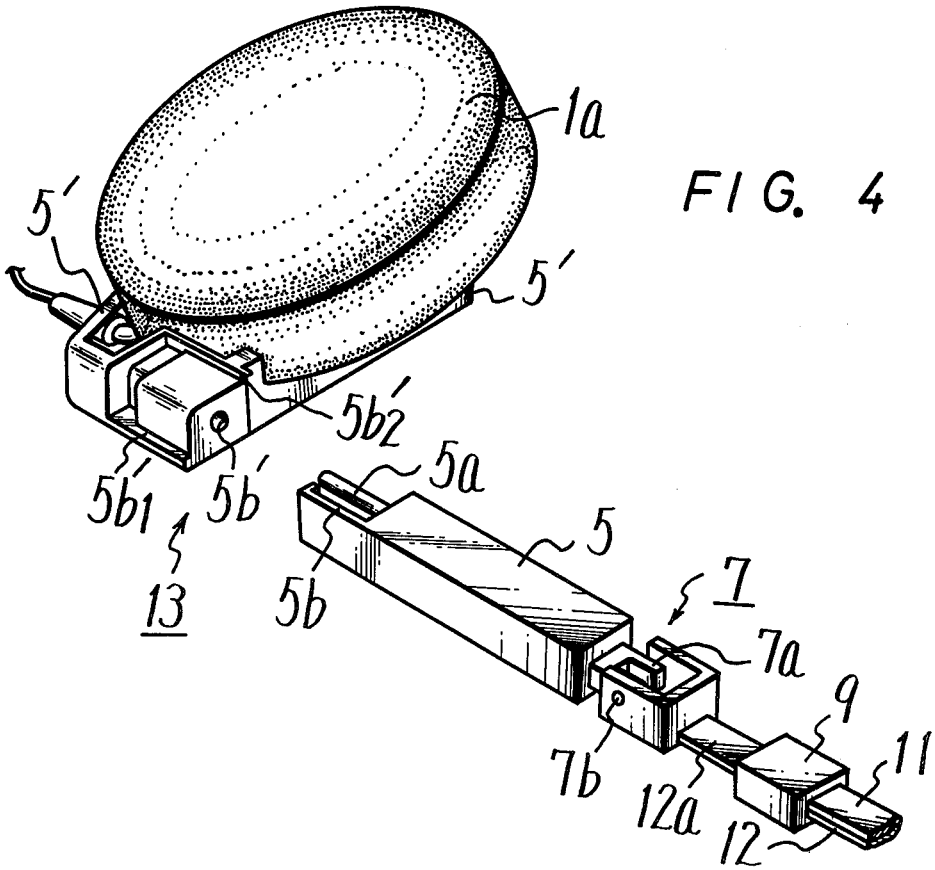
FIG. 4

HEAD PHONE

BACKGROUND OF THE INVENTION

1. Field of the Invention

The invention generally relates to a head phone and more particularly relates to a head phone which can be folded compactly.

2. Description of the Prior Art

In a previously proposed head phone, its electro-acoustic transducers for both ears such as, for example, speakers are held within housings, each formed like a flat disc or flat plate, and these flat-shaped housings are fixed at respective ends of, for example, thin head bands, each made of resilient material such as a metal, formed as substantially a semi-circular shape and coupled with one other so as to be extendable, shrinkable and slidable in such a manner that the planes of these flat housings are substantially perpendicular to the plane including the head bands.

Upon use of such head phone, expanding or contracting the head bands to meet a size of a user, the above housings holding therein the speakers are properly opposed to both ears of the user.

Whereas, when such head phone as described above is not used, ordinarily the head bands are contracted, or the housings holding therein the speakers are put one upon another or the head bands are arranged in such a fashion that they can be folded, and hence these head bands are folded and the housings are put one upon another so as to make the head phone compact for the convenience' sake of being handy to keep and carry.

But, in the known head phone, since the planes of the flat housings are substantially perpendicular to the plane including the head band as set forth above, no matter how compact the head phone is made by shortening the lengths of the head bands or folding the head bands, in view of the thickness of the head phone, it can not be made compact much more than the sizes of the housings (for instance, if each of the housings is formed as the disc-shape, then the diameter thereof). That is, the previously proposed head phone has a defect such that it is impossible to fold the overall of the head phone into a thin shape, thus resulting in inconvenience for keeping and carrying.

OBJECTS AND SUMMARY OF THE INVENTION

Accordingly, it is an object of the invention to provide a head phone which can obviate the afore-said defects inherent to the previously proposed head phone.

It is another object of the invention to provide a head phone of a simple construction which can be folded into a thin shape.

According to one aspect of the invention, there is provided a head phone comprising:

(a) a pair of housings, each holding therein an electro-acoustic transducer;

(b) a head band being extendable and shrinkable;

(c) a pair of supporting members, each being curved in substantially inverse L-shape with each other and supporting at its one end one of said pair of housings; and (d) a pair of pivotally supporting members, each being fixed with one of both ends of said head band and pivotally supporting the other end of one of said pair of supporting members in such a manner that each of said supporting members is rotatable around its lengthwise direction and also rotatable against the extending direction of said head band.

The other objects, features and advantages of the invention will become apparent from the following description taken in conjunction with the accompanying drawings through which the like references designate the same elements and parts.

BRIEF DESCRIPTION OF THE DRAWINGS

FIG. 3 is a schematic plan view of other example of the head phone according to the invention, in which the folded state thereof is presented; and FIG. 4 is an exploded perspective view of the main part thereof.

DESCRIPTION OF THE PREFERRED EMBODIMENTS

Now, let us describe a head phone of the invention hereinafter with reference to the drawings.

Figure 1:
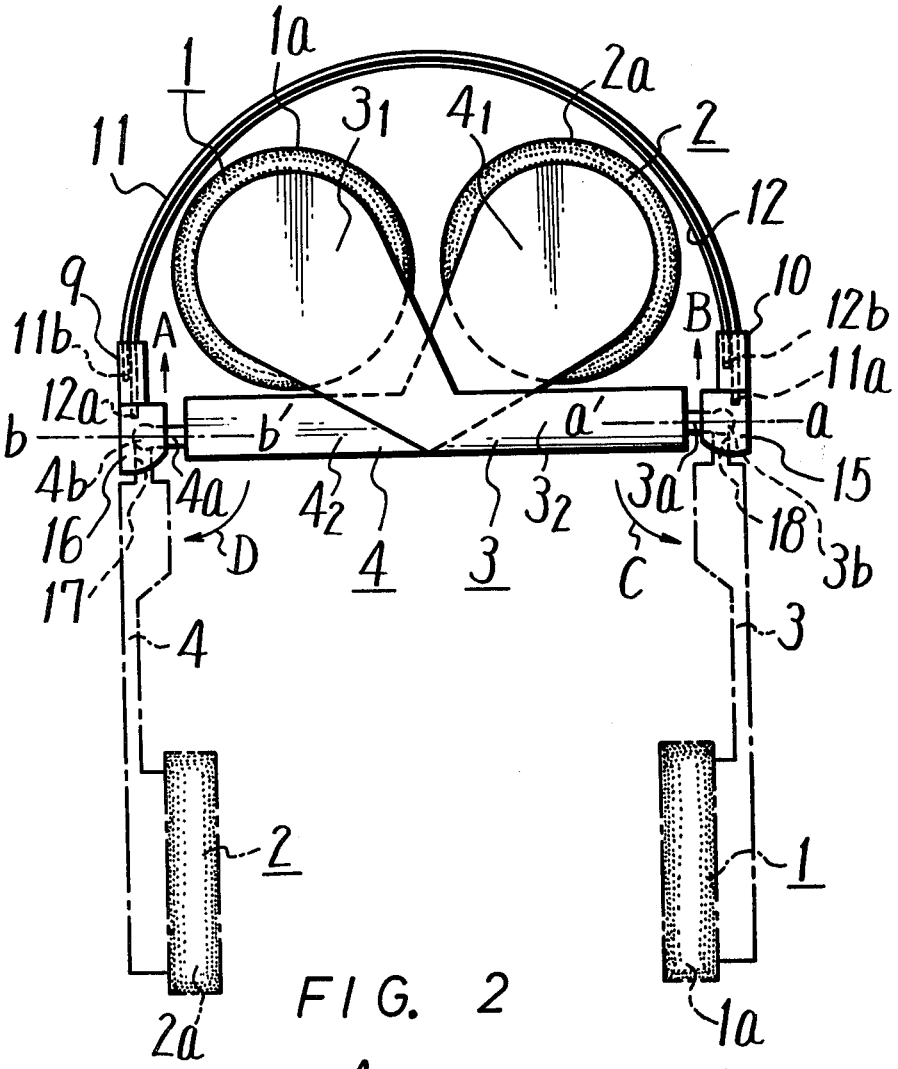
FIG. 1 is a schematic plan view of one example of a head phone according to the invention, in which the folded state thereof is presented.
Figure 2:
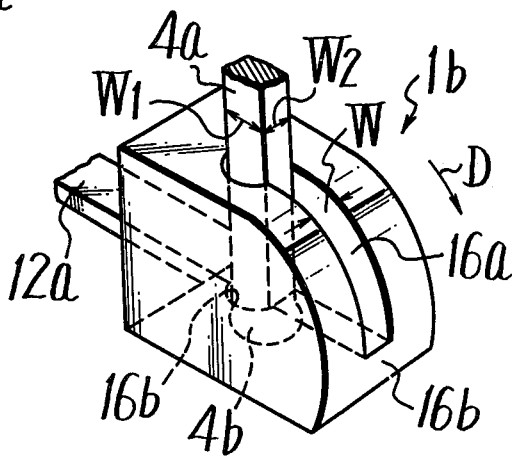
FIG. 2 is an enlarged perspective view of the main part thereof.

With reference to FIGS. 1 and 2, one embodiment of the invention will be described. FIG. 1 shows one example of the head phone according to the invention which is folded for the purpose of carrying or keeping, and FIG. 2 is an enlarged perspective view of the main part thereof.

In FIG. 1, reference numerals 1 and 2 denote housings formed like flat or thin plates or discs holding therein electro-acoustic transducers (not shown) such as, for example, speakers (ear phones). As is well known, the above speakers secured in the housings 1 and 2 are connected through wires or the like to a reproducing apparatus such as a tape recorder, a player and so on though not shown. Numerals 1*a* and 2*a* denote ear pads covering the housings 1 and 2, respectively. By the way, with this embodiment of the invention, the housings 1 and 2 are fixed to a pair of supporting member elements $3_1$ and $4_1$ of a pair of supporting members 3 and 4 at each one end thereof, each of the supporting member elements $3_1$ and $4_1$ being extended substantially vertically from each of other supporting member elements $3_2$ and $4_2$ and each of the supporting members 3 and 4 being curved in substantially inverse L-shape in the figure. Free end portions 3*a* and 4*a* of the supporting member elements $3_2$ and $4_2$, each extending substantially horizontally in the figure are coupled through pivotally supporting members 15 and 16, which will be described later, to end portions $11_a$ and $12_a$ of thin band-shaped head bands 12 and 11, each being made of resilient material such as stainless steel or the like and formed as an arc shape or substantially semi-circular shape. The other ends 11*b* and 12*b* of the head bands 11 and 12 are fixed to sliders 9 and 10, respectively. As is well known, since the sliders 9 and 10 are constructed in such a manner as to wrap the other head bands 12 and 11 one other to be slidable therealong, these sliders 9 and 10 are respectively slid from the folded state of the head phone shown in FIG. 1 to the directions denoted by arrows A and B so as to adjust the size of the loop formed by both of the head bands 11 and 12 in response to the size of the user's head. In this case, as shown in FIG. 1, in the state where the head phone is folded, that is, in the folded state of the head phone where the supporting members 3 and 4 are folded so as to be partially overlapped one other and the lengths of the head bands 11 and 12 are shortened most, the sizes of both the supporting members 3, 4 and the bent angles of their supporting member elements $3_1$, $3_2$ and $4_1$, $4_2$ are so selected that within the substantially semi-circular shape sector defined by the supporting members 3, 4 and the head bands 11 and 12, the housings 1 and 2 covered by ear pads 1*a* and 2*a* hardly contact with each other and other portions, but exist on the horizontal supporting member elements $4_2$ and $3_2$.

Next, the pivotally supporting members 15 and 16 will be discussed. The pivotally supporting members 15 and 16, which respectively support the supporting members 3 and 4 are substantially same in construction except for that the rotation direction of the supporting members 3 and 4 are opposite to each other. Therefore, only one pivotally supporting member, for example, 16 will be described with reference to FIG. 2. In FIG. 2, the end portion 4*a* projected from the supporting member element $4_2$ of the supporting member 4 is formed as a pin of rod-shape having a cross-section of substantially rectangular shape. On the tip end thereof, there is formed a ball-shaped portion 4*b* whose largest cross-section is a little larger than that of the rectangular-shaped pin 4*a*. Whereas, the pivotally supporting member 16 is formed of a block 16*b* having a fan or sector shaped groove or notch 16*a* with an apex angle of substantially 90°. On the corner or apical portion of the fan-shaped notch 16*a*, there is formed a ball-shaped through-hole 16*b* through which the above ball-shaped portion 4*b* is rotatably engaged. Moreover, the portion of this fan-shaped notch 16*a* through which the end portion or pin 4*a* with the rectangular cross-section is inserted upon the folded state of the head phone (state of FIG. 1) has such a size that under the state where the pin 4*a* is inserted thereinto, it is rotatable over an angle of 90°. The width W of other portion of the fan-shaped notch 16*a* is selected to be narrower than a larger width $W_1$ of the pin 4*a* with the rectangular cross-section but a little broader than the smaller width $W_2$ thereof due to the reason which will be described later. The end portion 12*a* of the head band 12 is engaged into the bottom portion of the block 16*b* to be fixed in FIG. 2.

Next, an operation to put the head phone, which is in the folded state as shown in FIG. 1, into the state being ready for use will be described. First, the respective supporting members 3 and 4 are rotated by about 90° in a direction perpendicular to the plane of the sheet of the drawing of FIG. 1 around the pivotally supporting members 15 and 16, taking respective axes a-a' and b-b' of their end portions 3*a* and 4*a* as the center. Then, the housings 1 and 2 respectively rise up to rest on the plane substantially perpendicular to the plane of the same sheet. At this time, the end portion 4*a* (3*a*) with the rectangular cross-section of the supporting member element $4_2$ ($3_2$) is opposed, as shown in FIG. 2, to the fan-shaped notch 16*a* at its surface having the narrower width $W_2$. Next, the respective supporting members 3 and 4 are rotated by substantially 90° in the directions denoted by arrows C and D in FIG. 1. Speaking more precisely, the pin 4*a* (3*a*) as shown in FIG. 2 is pivoted in the direction denoted by the arrow D so as to contact with the bottom portion of the fan-shaped notch 16*a*. If so, as shown by a dotted line in FIG. 1, the head phone is put into the state being ready for use. In this case, it is needless to say that if necessary, the head bands 11 and 12 are mutually extended from the state shown in the figure.

At that time, since the thin plate-shaped housings 1 and 2 are respectively supported by the substantially L-shaped supporting members 3 and 4, they exist within the planes substantially perpendicular to the plane including the head bands 11 and 12 and also their centers are apart from the plane. Accordingly, upon use, that is, when the housings 1 and 2 holding therein the electro-acoustic transducers such as the speakers though not shown and covered by the ear pads 1*a* and 2*a* are closely opposed to the respective ears of the user, the head bands 11 and 12 will never touch the ears directly. Furthermore, since the housings 1 and 2 exists within the planes substantially perpendicular to the plane including the head bands 11 and 12 and also they are spaced apart from the plane, the spring forces of the head bands 11 and 12 act on the housings 1 and 2 as the torsion forces, such an effect is achieved that the housings 1 and 2 are pressed against the ears with suitable pressing forces.

When the head phone in the used state is folded for portable use, if the operations contrary to the above are performed, it is possible to put the head phone into the thin and flat state (thickness of which state is substantially same as that of each of the housings 1 and 2) easily. Thus a small space is sufficient for keeping the head phone, that is, the head phone can be housed in a small thin case, such as a cassette for an ordinary tape.

FIG. 3 is a schematic view of other embodiment of the head phone according to the invention showing its folded state, and FIG. 4 is a perspective view of the disassembled main parts thereof, in which like references designate same elements and parts as those of FIG. 1 and hence their detailed explanations will be omitted for simplicity.

With the embodiment of FIGS. 3 and 4, the supporting members for supporting the housings 1 and 2 covered with the ear pads 1*a* and 2*a* are respectively comprised of pairs of supporting members 5, 5' and 6, 6', which are all independent bodies. One of each of the pairs of the supporting members 5, 5' and 6, 6' is coupled at each one end to the other by way of the pivotally supporting members 13 and 14 so as to form the substantially L-shape as shown in FIG. 3. In this case, the housings 1 and 2 are fixed to the other supporting members 5' and 6' at their free ends, respectively. Both of the pivotally supporting members 13 and 14 are substantially the same except for that the rotational directions of the supporting members 5' and 6' are different. Therefore, let us proceed the description of one pivotally supporting member, for example, 13 with reference to FIG. 4, which is equal to the back surface of the head phone shown in FIG. 3. As illustrated in FIG. 4, on one end of one supporting member 5, there are formed protrusively a column-like or circular pin 5*a* and a tongue piece 5*b* forming one member of a stopper, which will be described later. On the other hand, on one end of the other supporting member 5', there are respectively provided a through-hole 5*a'* rotatably supporting the pin 5*a* and abutting portions $5'b_1$ and $5'b_2$ to respectively abut against the tongue piece 5*b* at respective rotated positions of each 90°.

Turning back to FIG. 3 again, the other ends of the respective supporting members 5 and 6 are respectively coupled through the pivotally supporting members 7 and 8 to the head bands 12 and 11 at their one ends 12*a* and 11*a*. Both of the pivotally supporting members 7 and 8 are of the substantially same construction as one another except the difference in the rotational directions of the respective supporting members 5 and 6, so one pivotally supporting member, for example, 7 will be described with reference to FIG. 4.

As shown in FIG. 4, at a bottom of a bracket 7*a* formed like a hollow rectangular body whose adjoining two surfaces are removed, there is fixed one end 12*a* of one head band 12, while the other end of the supporting member 5 is pivotally secured to the inside of the bracket 7*a* by a pin 7*b* so that the supporting member 5 can be rotated about the pin 7*b* with the angle of substantially 90° within the plane including the flat surface of the flat head band 12.

Next, an operation to put the head phone in the folded state as shown in FIG. 3 into the state being ready for use will be described. If the forces originating from the lower side to the upper side of the plane of the sheet of the drawing are respectively applied to the housings 1 and 2 in the folded state shown in FIG. 3, the supporting members 5′ and 6′ are respectively rotated by about 90° in the direction substantially perpendicular to the plane of the sheet of the drawing about the pivotally supporting members 13 and 14 relative to the other supporting members 5 and 6 and then they are risen nearly vertically to the plane of the sheet of the drawing. At this time, the abutting member $5'b_1$ abuts against the tongue piece 5*b*, so that the supporting member 5′ is not rotated more than ever. The rotation of the other supporting member 6′ does not proceed more than ever likewise. Next, the respective supporting members 5 and 6 are rotated to the outsides (refer to the arrows C and D in FIG. 3) about the pivotally supporting members 7 and 8 with an angle of about 90°. Then, the supporting members 5 and 6 become substantially parallel to each other and hence the head phone is put into the state being possible for use. That is, the head phone is put into the state shown by the dotted line in FIG. 3. In this case, while FIG. 3 illustrates one supporting members 5 and 5′ and the housing 1 only, it will be clear that the other arrangements of those 6, 6′ and 2 are the same as those of 5, 5′ and 1. The pivotally supporting member 7 is constructed such that after the supporting member 5 was rotated as shown by the dotted line in FIG. 3, it prevents the supporting member 5 from being rotated much more. In other words, in FIG. 4 which shows the state that the supporting member 5 is rotated as described above, the bottom surface of the bracket 7*a* abuts against the supporting member 5 so as to inhibit the further rotation of the supporting member 5.

To put the head phone from the folded state shown in FIG. 3 into the state being ready for use, it will be apparent that another operation method may be possible, where first of all, the supporting members 5 and 6 are rotated relative to the head bands 12 and 11 through the coupling members 7 and 8 and thereafter the supporting members 5′ and 6′ are rotated about the supporting members 13 and 14.

With the embodiment of the invention seen in FIG. 3, it will be obvious that the same function and effect as those of FIG. 1 are also achieved.

The above description is given on the preferred embodiments of the invention, but it will be apparent that many modifications and variations could be effected by one skilled in the art without departing from the spirits or scope of the novel concepts of the invention, so that the scope of the invention should be determined by the appended claims only.

We claim as our invention:

1. A head phone comprising:
(a) an adjustable head band;
(b) a pair of housings each holding an acoustic transducer;
(c) a pair of substantially L-shaped supporting members each having mounted at the end of one leg a housing;
(d) means for articulatingly connecting each of the supporting members to a respective end of said head band for movement between a folded position wherein said housings lie in the plane of and within the head band and a use position wherein said housing lies in a plane extending substantially perpendicular to the plane of the head band and the centers of said housing lie on a common line spaced from the plane of said band.

2. The head phone according to claim 1 wherein said L-shaped supporting member comprises first and second legs fixed to each other at an angle of approximately 90°, said housing being secured to said first leg and said second leg being pivotally connected at its free end to the respective end of said head band, said supporting members being arranged in inverse opposition to each other and being rotatable about the axis of said second leg to move said housing between the folded and use positions relative to the plane of said head band and swingable solely in the plane of said head band between the folded position and the use position wherein said second leg extends axially from the end of said head band to align the centers of said housings.

3. The head phone according to claim 2 including means for arresting the movement of said supporting member at the extreme limits of said folded and use positions.

4. The head phone according to claim 2 wherein said pivotal connection comprises a ball and socket joint.

5. The head phone according to claim 4 wherein said socket is formed with a slotted guideway limiting swinging of the leg in a plane coincident with the plane of said head band.

6. The head band according to claim 1 wherein said L-shaped supporting member comprises a first arm and a second arm rotatably coupled to each other at an angle of substantially 90°, the housing being mounted at the free end of said first arm, the free end of said second arm being pivotally connected to the end of head band, said first arm being swingable about the axis of said second arm in a plane perpendicular to the plane of the head band and said second arm being swingable about the end of said head band in the plane of said head band.

7. The head band according to claim 5 including means for limiting the movement of said first arm relative to said second arm to an angle of 90°, and the movement of said second arm relative to the end of said head band to an angle of 90°.

* * * * *